United States Patent [19]

Fukumoto et al.

[11] 4,051,632

[45] Oct. 4, 1977

[54] WINDOW GLASS MOUNTING MEANS FOR AUTOMOBILES

[75] Inventors: Ryoichi Fukumoto, Nagoya; Toshiro Igarashi, Hoigun, both of Japan

[73] Assignees: Aisin Seiki Kabushiki Kaisha; Toyota Shatai Kabushiki Kaisha, both of Kariya, Japan

[21] Appl. No.: 694,446

[22] Filed: June 9, 1976

[30] Foreign Application Priority Data

June 21, 1975 Japan ..... 50-76161

[51] Int. Cl.[2] ..... E05F 11/38

[52] U.S. Cl. ..... 49/348; 49/227; 49/375

[58] Field of Search ..... 49/348-353, 49/227, 374, 375

[56] References Cited

U.S. PATENT DOCUMENTS

| | | | |
|---|---|---|---|
| 2,844,405 | 7/1958 | Roethel | 49/375 |
| 3,228,677 | 1/1966 | Martens | 49/349 X |
| 3,844,064 | 10/1974 | Yamaha et al. | 49/348 |
| 3,868,788 | 3/1975 | Podolan | 49/350 X |

*Primary Examiner*—Philip C. Kannan

*Attorney, Agent, or Firm*—Finnegan, Henderson, Farabow & Garrett

[57] ABSTRACT

In an automobile including a door panel having a window opening and a window glass mounted in the door panel for vertical movement. The window glass is provided at its lower portion with a support bracket carrying a guide follower which is in sliding engagement with a vertical guide rod. The guide follower is mounted on the bracket by a pivot pin at one end thereof and an adjusting screw at the other end in such a manner that the window glass can be laterally adjusted with respect to the door panel only through actuation of the adjusting screw.

8 Claims, 13 Drawing Figures

WINDOW GLASS MOUNTING MEANS FOR AUTOMOBILES

Figure 1:
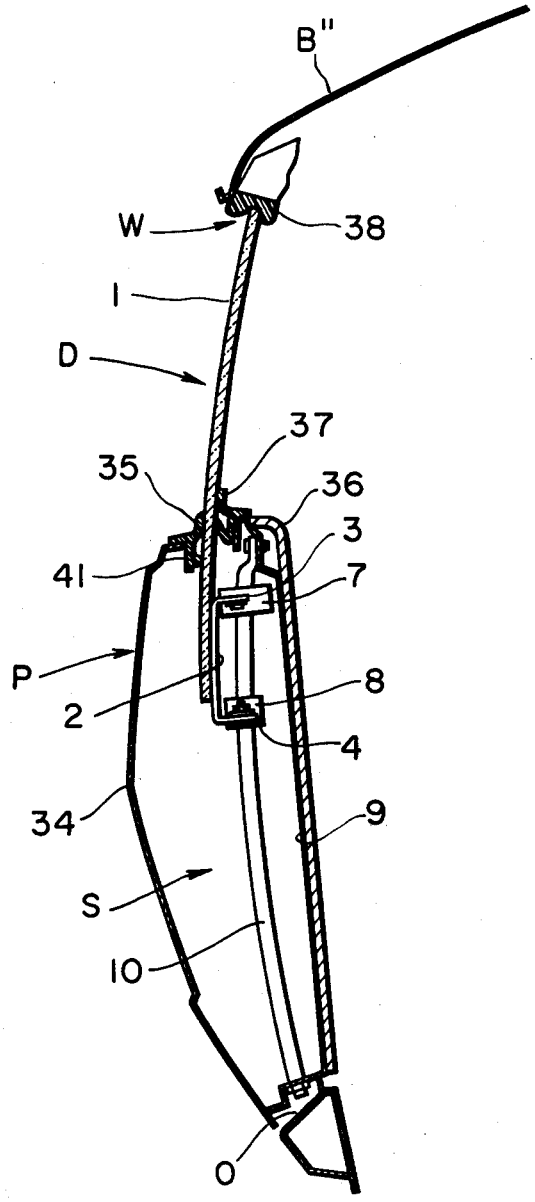

The present invention relates to window glass mounting mechanisms for vehicles, and more particularly to such mounting mechanisms having means for adjusting the position of the window glass.

Most of automobiles such as passenger cars are provided with window openings which are adapted to be closed by retratable window glasses. The window openings are provided around their peripheries with weather seal strips against which the window glasses are brought into sealing contact when closed. The window glasses are normally supported at their lower ends by guide means which are adapted to guide the window glasses in vertical directions between open and close positions.

In order to provide a satisfactory weather tightness, the upper edges of the window glasses must be properly seated against the co-operating weather seal strips. If the upper edges of the window glasses are misplaced with respect to the co-operating seal strips, sealing engagements between the window glasses and the weather seal strips may be easily broken by laterally outwardly acting suction pressure which may possibly be produced when the automobiles are running at a high speed and may cause deflections of the window glasses.

Therefore, in order to ensure proper locations of the window glasses with respect to the weather sealing strips, adjustment devices have widely been employed in the window glass guide means so that the lateral positions of the upper edges of the window glasses can be adjusted as desired.

Conventional adjusting mechanism employed for this purpose comprises a window glass support bracket secured to the lower part of a window glass and carrying a guide follower which slidably engages a substantially vertically extending guide rod stationarily mounted in the car body or in the door panel as the case may be. A window driving or actuating mechansim is provided for moving the window glass in substantially vertical direction along the guide rod through manually operated mechanical means or electrically operated means. Usually, the guide follower includes a pair of extensions or flanges at the opposite sides thereof, each of the flanges being provided with an elongated slot for receiving a tightening bolt which serves to fasten the guide follower to the window glass support bracket. Thus, the guide follower is mounted on the window glass support bracket in such a manner that adjustment can be made in respect of the distance between the bracket or the window glass and the guide follower or the guide rod. Since the window glass is restrained from lateral movement at the lower edge of the window opening by means of the weather seal strip, the aforementioned adjustment of the support bracket causes a lateral swinging movement of the window glass about the seal strip. Therefore, the lateral position of the upper edge of the window glass can be adjusted as desired with respect to the upper weather seal strip through the aforementioned adjusting operation.

The conventional adjusting mechanism has been found disadvantageous, however, because in this type of mechanism it is required to make adjustments at the two bolt-slot connections. Since the mechanism is housed in a very small space available in a car body or a door panel assembly, the adjustment takes a considerable labour and time.

The present invention has therefore an object to provide vehicle window glass mounting means including simple means for adjusting lateral position of the window glass.

Another object of the present invention is to provide window glass mounting means with means for adjusting the lateral position of the window glass through actuation of a single screw.

According to the present invention, the above and other objects can be accomplished in an automobile including panel means which has at least one window opening, a window glass mounted in said panel means for movement substantially in vertical direction between a closed position wherein the window glass closes the window opening and an open position wherein the window opening is fully opened, and window glass actuating means for actuating the window glass to move it between said open and closed positions, the improvement comprising window glass mounting means including window glass support bracket means secured to the window glass, substantially vertically extending guide rail means stationarily disposed in said panel means, guide follower means slidably engaged with the guide rail means, means for connecting said guide follower means with said bracket means, said connecting means including pivot connection means at one point of said guide follower means for allowing a swinging movement of the guide follower means in substantially horizontal plane and adjustable connection means at another point apart from said one point of said guide follower means. Preferably, said adjustable connection means comprises an adjusting screw axially immovably attached to the guide follower means and threadably engaged with said bracket means, so that the adjustment can be performed only through rotation of the screw.

Other objects and advantages of the invention will become apparent from the following description of embodiment with reference to the accompanying drawings in which:

FIG. 1 is a sectional view fragmentarily showing a body of an automobile.

Figure 2:
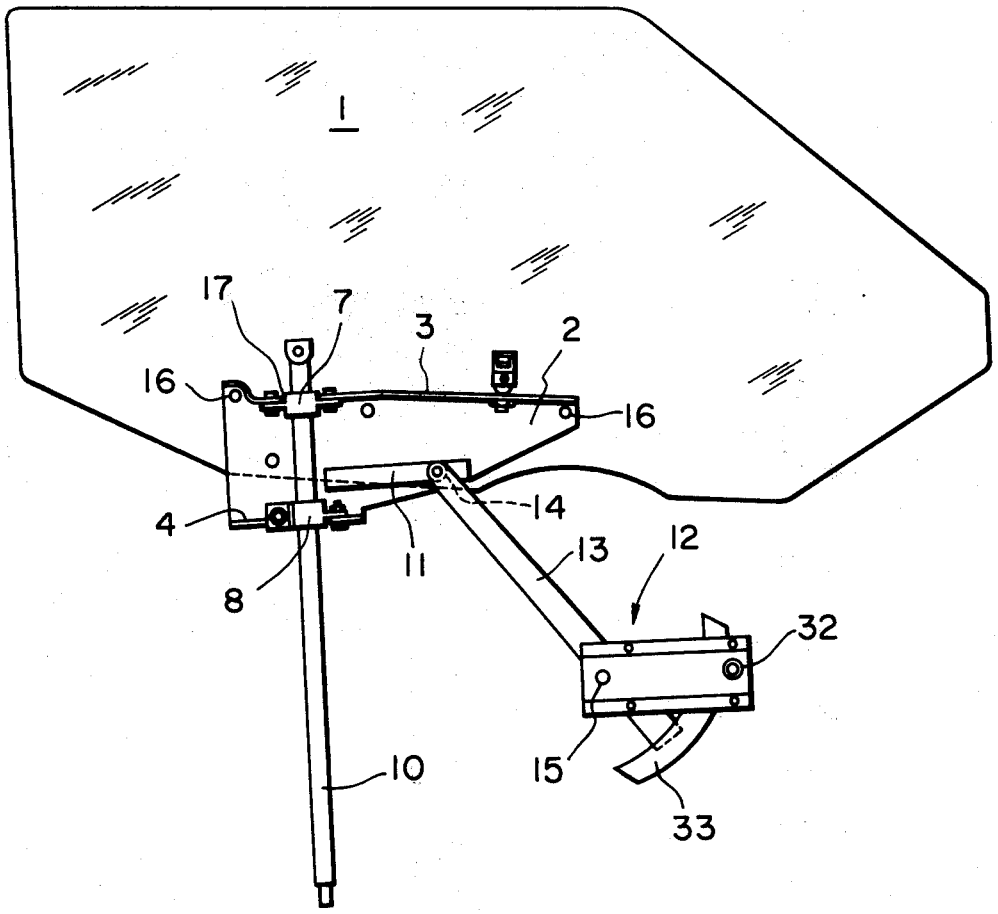
Figure 3:
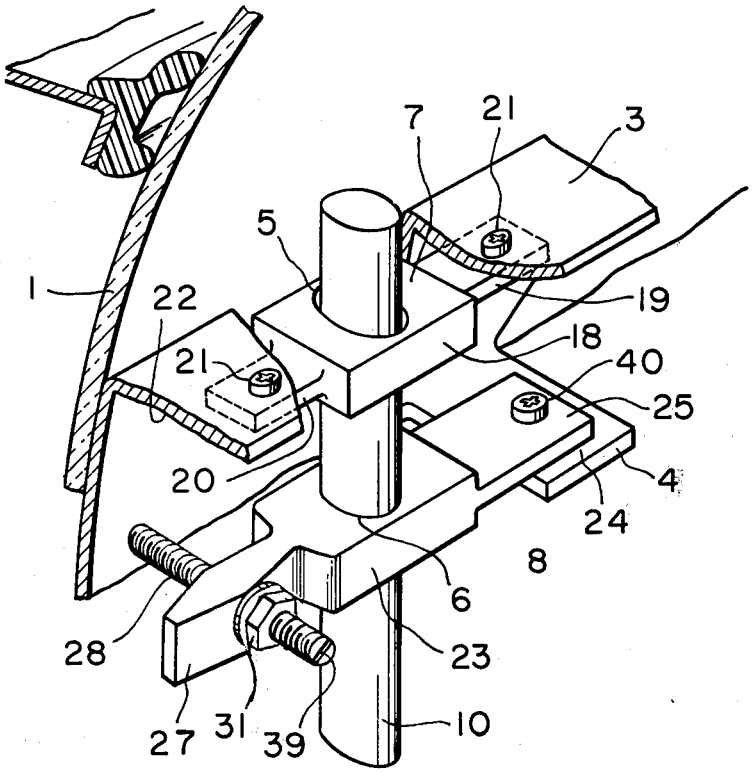
Figure 4A:
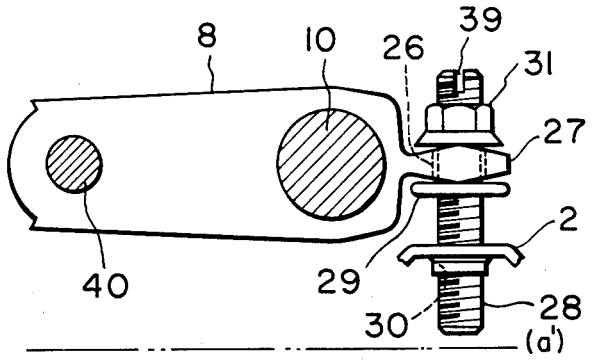
Figure 4B:
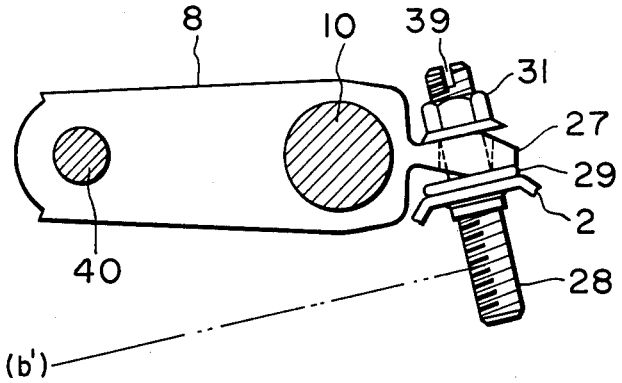
Figure 4C:
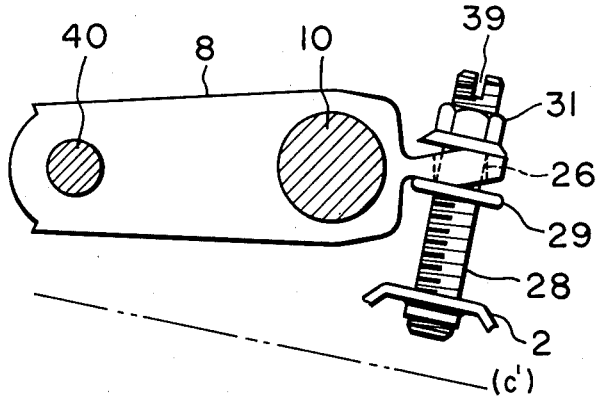
Figure 5:
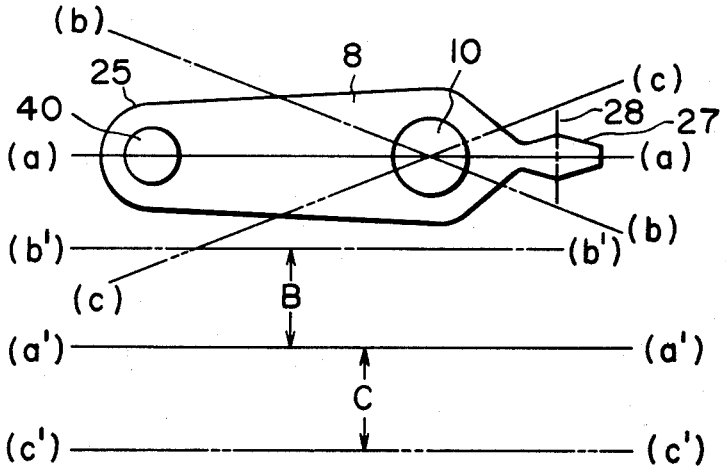
Figure 6:
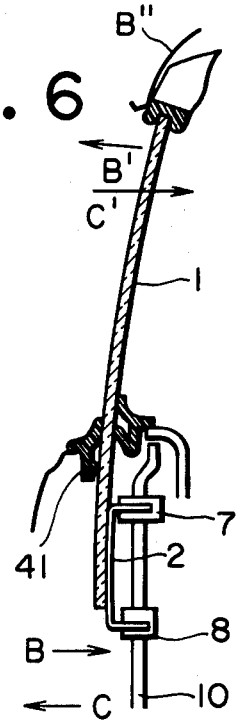
Figure 7A:
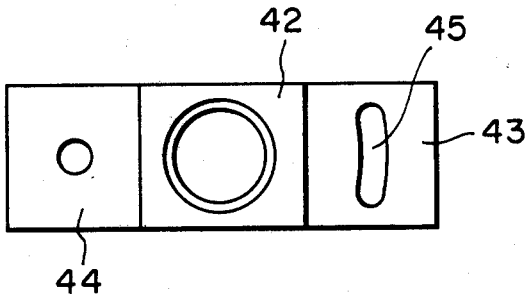
Figure 7B:
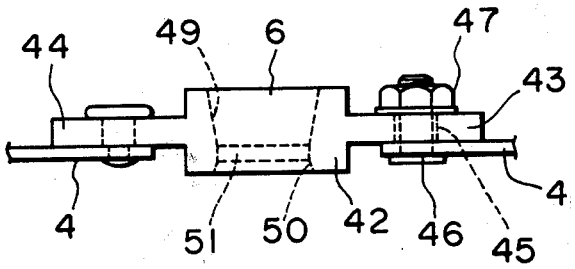
Figure 8:
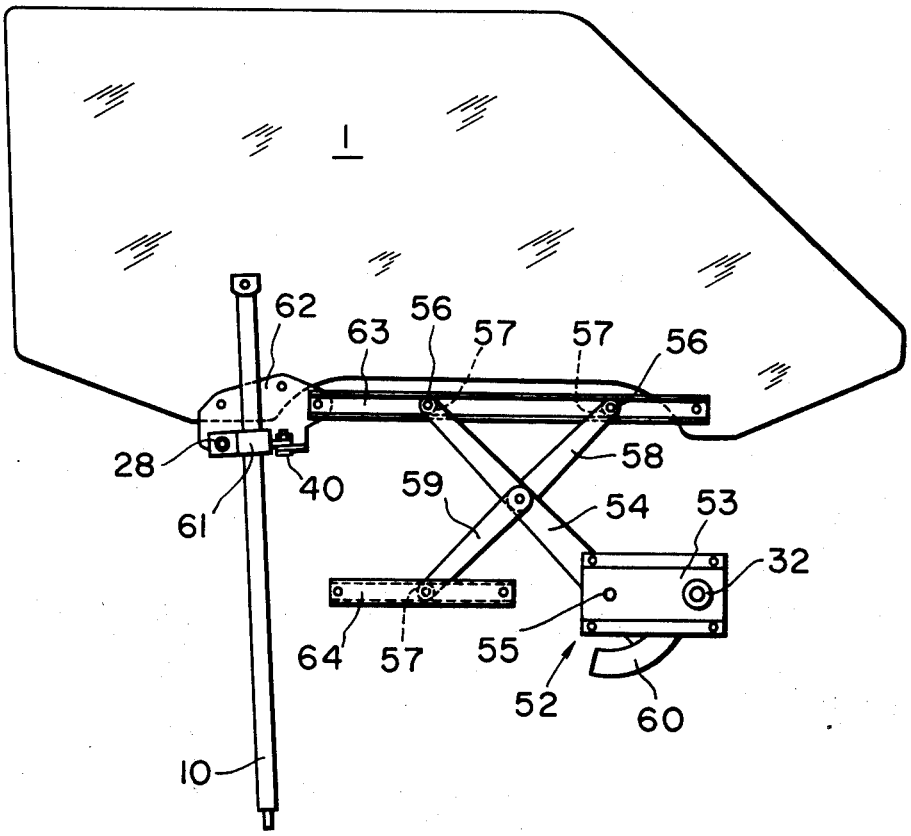
Figure 9A:
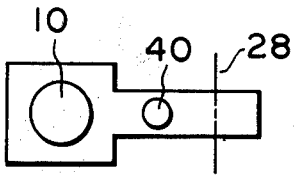
Figure 9B:
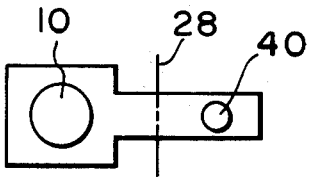

FIG. 2 is a elevational view showing a window glass mounting means for automobiles, FIG. 3 is a fragmentary perspective view of a window regulator, FIGS. 4 (*a*), (*b*) and (*c*) are plan views illustrating the movement of follower when adjusted, FIG. 5 is a diagrammatic view showing the location of the end of window glass during adjustment thereof, FIG. 6 is a sectional fragmentary view illustrating the direction of movement of the window glass when adjusted, FIGS. 7 (*a*) and (*b*) are views showing another embodiment of a lower guide follower, FIG. 8 is a view similar to FIG. 2 in which another embodiment of the present invention is shown, FIGS. 9 (a) and (b) are views showing the modification of location of a adjusting screw and a pin.

Referring now to the drawings, particularly to FIG. 1, there is fragmentarily shown a body (B") of an automobile which has a side opening O as is common in the art. The opening O of the car body is adapted to be closed by a door assembly D which comprises a door panel assembly P having a window opening W at the upper portion thereof. A window glass (1) is vertically slidably arranged in the door panel assembly P so that it closes the window opening W in its upper position.

In order to support the window glass 1 for vertical sliding movement between the upper close position and the lower open position, a guide follower support member or bracket 2 is secured to the lower portion of the window glass 1. The support bracket 2 is formed at its upper and lower edges with flanges 3 and 4 which respectively carry upper and lower guide followers 7 and 8.

The door panel assembly P comprises an outer panel 34 and an inner panel 9 which are assembled together to provide a hollow space S therebetween. In the space S of the door panel assembly P, there is disposed a guide rod 10 which extends substantially vertically and is secured to the inner panel 9 at the opposite ends thereof. Recommendably, the guide rod 10 has a curvature which substantially conforms to that of the window glass 1. The guide followers 7 and 8 have vertically aligned holes 5 and 6 which are adapted to slidably engage the guide rod 10 as shown in FIG. 3.

In order to drive the window glass 1 in the vertical direction, there is provided a window drive or actuating mechanism 12 which comprises an actuating arm 13 swingably mounted on the door panel assembly P by means of a pivot shaft 15 and having one end provided with a segmental gear 33. The door panel P is provided with a manually operated shaft 32 which carries a pinion gear (not shown) meshing with the segmental gear 33. The support bracket 2 is provided with a substantially horizontally extending rail member 11 of channel shaped cross-sectional configuration which is engaged with a roller 14 carried by the free end of the arm 13. Thus, it will be understood that, as the manually operated shaft 32 is rotated, the rotation is transmitted through the pinion to the segmental gear 33. Therefore, the arm 13 is swung about the pivot shaft 15 and the swinging movement of the arm 13 is then converted at the rail 11 into a vertical movement of the member 2 and the window glass 1. Thus, the window glass 1 is caused to move vertically along the guide rod 10.

The window glass support bracket 2 is generally made of a metallic material and secured to the window glass by means of screws 16. The upper and lower flanges 3 and 4 of the member 2 are formed by bending the corresponding edges of the bracket 2 inwardly. In order to accommodate the upper guide follower 7, the upper flange 3 is formed with a cutout 7. It is to be noted that the upper flange 3 may extend throughout the length of the upper edge of the bracket 2, but the length of the lower flange 4 must be so determined that it does not interfere with the operation of the window driving or actuating mechanism 12. In the preferred embodiment shown in the drawings, it will be seen that the bracket 2 is cutoff obliquely at the lower side as shown in FIG. 2 so as to avoid possible interference between the arm 13 and the lower flange 4. The upper and lower flanges 3 and 4 have further effect of providing required stiffness or rigidity in the bracket 2.

The upper guide follower 7 is preferably made of a plastic material and comprises a body 18 having extensions 19 and 20 extending outwardly from the opposite edges thereof. The follower 7 is inserted into the cutout 17 formed in the upper flange 3 with the extensions 19 and 20 located beneath the flange 3 so that they are in contact with the lower surface 22 of the flange 3. The follower 7 is thus secured to the flanges 3 at the extensions 19 and 20 by means of bolts 21. The hole 5 for accommodating the guide rod 10 is formed in the body 18 of the follower 7.

The lower guide follower 8 comprises a body 23 having the aforementioned hole 6. The body 23 is formed with a first extension 25 extending outwardly from one side thereof and a second extension 27 extending outwardly from the opposite side. The first extension 25 has a flat lower surface adapted to be brought into engagement with the upper surface 24 of the lower flange 4. The first extension 25 is attached to the lower flange 4 by means of a pin 40 so that the follower 8 is swingable about the pin 40.

The second extension 27 is formed with a transverse hole 26 which is adapted to receive an adjusting screw 28. The screw 28 is integrally formed with an annular flange 29 for engaging one side surface of the extension 27. A nut 31 is installed on the end of the screw 28 so that the extension 27 is disposed between the flange 29 and the nut 31. As shown in FIGS. 4(*a*), 4(*b*) and 4(*c*), the thickness of the extension changes in such a manner that the thickness is the largest at the center of the transverse hole 26 and gradually decreases toward the both sides of the hole 26. Since the hole 26 has a diameter which is large in relation to the diameter of the screw 28, the screw 28 is allowed to conduct an angular displacement with respect to the follower 8.

The holding member 2 is formed with a threaded hole 30 which engages with the screw 28. The screw 28 is formed at an end adjacent to the nut 31 with a radially extending slot 39 for accommodating a screw driver or like tool. Thus, by rotating the screw 28, the lower guide follower 8 is rotated about the guide rod 10 with respect to the window glass support bracket 2.

As shown in FIG. 1, the outer and inner door panel 34 and 9 of the door panel assembly P are provided at the lower edge portion of the window opening W with an outer and an inner weather strips 35 and 37 which to some extent serve to constrain the window glass 1 against rotating movement. The aforementioned rotation of the lower guide follower 8 will therefore exerts a lateral bias pressure through the pin 40 to the window glass 1 so that the glass 1 is forced against either of the weather strips 35 and 37. The door panel assembly P is further provided with an upper seal strip 38 against which the upper edge of the window glass 1 is forced into sealing contact when it is in the close position.

In order to ensure that the upper edge of the window glass 1 is properly seated against the upper seal strip 38, adjustment must appropriately be made when the window glass 1 is installed on the door panel assembly. The aforementioned mechanism of the present invention is particularly intended to facilitate the adjustment.

The manner of such adjustment will hereinafter be described taking reference to FIGS. 3, 5 and 6. Referring now to FIG. 5, when the lower guide follower 8 is in the nominal position with its longitudinal axis positioned as shown by the solid line *a—a*, the window glass 1 may be located as diagrammatically shown by the solid line *a'—a'*. If the window glass 1 is correctly positioned, the upper edge of the glass 1 is properly seated against the upper seal strip 38 to provide a required weather tightness.

However, when the upper edge of the window glass 1 is offset with respect to the upper seal strip 38, an adjustment can be made by rotating the screw 28 to turn the lower guide follower 8 about the guide rod 10 in either direction so that the longitudinal axis of the follower 8 is positioned as shown by either of the dashand-dotted lines *b—b* and *c—c*. When the follower 8 is oriented as schematically shown by the line *b—b*, the lower portion of the window glass 1 will be displaced in the direction shown by an arrow B to the position as shown by the line *b—b'*, *but when the follower 8 is oriented as shown by the line c—c*, the lower portion of the glass 1 will be displaced in the direction shown by an arrow C to the position *c'—c'*.

In this instance, the weather strips 35 and 37 contrains the window glass 1 against the tendency of rotation which will otherwise be produced about the pin 40 when the screw 28 is rotated. Therefore, either of the weather strips 35 and 37, particularly the rigid portion 41 of the weather strip 35 serve as a fulcrum about which the window glass 1 is rotated. Thus, the upper edge of the window glass 1 is shifted in either of the direction shown by arrows B' and C' in FIG. 6 when the screw 28 is rotated and the lower portion of the glass 1 is laterally moved as shown by either of arrows B and C. After the adjustment is completed, the nut 31 is fastened.

Referring now to FIGS. *7a* and *7b*, there is shown another embodiment of the lower guide follower in accordance with the present invention. The guide follower comprises a body 42 and a pair of flanges 43 and 44 extending outwardly from the opposite sides of the body 42. In this embodiment, the flange 44 has a flat lower surface which is placed on the upper surface of the lower flange 4 on the bracket 2. The flange 44 is then connected to the lower flange 4 of the bracket 2 by means of a pin for swinging movement in a horizontal plane.

The other flange 43 is formed with an arcuated slot 45 which is adapted to be aligned with a corresponding bolt hole in the lower flange 4 of the bracket 2. A bolt 46 is inserted through the bolt hole and the slot 45 and a nut 47 is threadably engaged therewith so as to tighten the follower in a properly oriented position.

The body 42 is formed with a hole 6 as in the previous embodiment for inserting the guide rod 10. Preferably, the hole 6 comprises two outwardly enlarged frustoconical portions 49 and 50 and a cylindrical portion 51 between the frustoconical portions 49 and 50 as shown in FIG. *7b*. The cylindrical portion 51 of the hole 6 slidably engages the guide rod 10 and thus the guie follower is rotatable about the guide rod 10.

In order to allow the aforementioned adjustment, the hole 5 in the upper guide follower 7 is in the form of an elongated slot so that the inclination of the window glass 1 can be changed taking the portion 41 of the outer weather strip 35 as the fulcrum. In a design wherein the trace of the upper edge of the window glass 1 between the closed and the open positions does not conform to the curvature of the vertical section of the guide rod 10, the glass is guided by the portion 41 of the outer weather strip 35 as well as the guide rod 10, so that it is also required to constitute the hole 5 in the form of an elongated slot in order to allow lateral displacement of the follower 7 with respect to the guide rod 10.

The arrangement of the present invention is advantageous over the prior art in that the aforementioned adjustment of the window glass is performed only through actuation of a single member such as the screw 28. Thus, the labour and time required for the adjustment can be remarkably decreased. Therefore, the present invention is effective to facilitate assembling operation of the door.

FIG. 8 shows another embodiment of the present invention in which only a single guide follower is employed. In this embodiment, the window glass 1 is provided at its lower portion with a guide follower support bracket 62 which carries a guide follower 61 attached thereto by means of a pin 40 as in the previous embodiment. The guide follower 61 slidably engages a guide rod 10 which is secured to the door panel assembly (not shown). As in the previous embodiment, the guide follower 61 can be angularly shifted by means of an adjusting screw 28.

In order to drive or actuate the window glass 1 in vertical direction, there is provided a window actuating mechanism 52 which comprises an actuating arm 54 pivoted to a base plate 53 on the door panel by means of a pivot pin 55. The arm 54 has a segmental gear 60 secured to one end thereof and is provided at the other end with a roller 57 mounted thereon by a pin 56. A manually operated shaft 32 is mounted on the base plate 53 and carries a pinion (not shown) which is in meshing engagement with the segmental gear 60.

A guide rail 63 of a channel shaped configuration is attached to the window glass 1 so as to extend in the horizontal direction. The roller 57 on the arm 54 is received by the rail 63 to move along the rail. An equalizer arm 58 is pivotably attached at one end to an intermediate point of the actuating arm 54 and has a roller 57 mounted thereon at the other end by means of a pin 56. The roller 57 is in engagement with the rail 63. Another equalizer arm 59 is pivotably attached at one end to the arm 54 at the same point where the first equalizer arm 58 is attached. The arm 59 has a roller 57 mounted on the other end thereof by means of a pin 56. The roller 57 on the arm 59 is in engagement with a guide rail 64 which is in parallel with the rail 63 and secured to the door panel.

In this arrangement, any play of the window glass 1 in the plane substantially parallel thereto can be removed or taken off by the window actuating mechanism 52, particularly by the actuating arm 54 which engages the rail 63 through the roller 57 provided thereon. The lateral movement of the window glass 1 is restrained by the engagement of the guide rod 10 and the guide follower 61 as well as the weather strips provided in the lower edge of the window opening.

In the previous embodiments, the pin 40 and the adjusting screw 28 or the tightening bolt 46 are disposed at the opposite sides of the guide rod 10. It should be noted however that the arrangement can be modified within the scope of the present invention as shown in FIGS. 9(*a*) and (*b*). In FIG. 9(*a*), the adjusting screw 28 is located at the same side of the guide rod 10 as the pin 40 but the pin 40 is nearer to the guide rod 10 than the screw 28. In FIG. 9(*b*), the locations of the screw 28 and the pin 40 are reversed with respect to the guide rod 10.

The invention has thus been shown and described with reference to specific embodiments, however, it should be noted that the invention is in no way limited to the details of the illustrated structures but changes and modifications may be made without departing from the scope of the appended claims.

We claim:

1. In an automobile including panel means which has at least one window opening, a window glass mounted in said panel means for movement substantially in vertical direction between a closed position wherein the window glass closes the window opening and an open position wherein the window opening is fully opened, and window glass actuating means for actuating the window glass to move it betweend said open and closed positions, the improvement comprising window glass mounting means including window glass support bracket means secured to the window glass, substantially vertically extending guide rail means stationarily disposed in said panel means, guide follower means slidably engaged with the guide rail means, means for connecting said guide follower means with said bracket means, said connecting means including pivot connection means at one point of said guide follower means for allowing a swinging movement of the guide follower means in substantially horizontal plane and adjustable connection means at another point apart from said one point of said guide follower means.

2. Window glass mounting means in accordance with claim 1 in which said guide follower means includes a guide follower comprising a body which is provide with a hole for slidable engagement with the guide rail means, a first portion having said pivot connection means, and a second portion having said adjustable connection means.

3. Window glass mounting means in accordance with claim 2 in which said adjustable connection means comprises an adjusting screw axially immovably attached to the guide follower means and threadably engaged with said bracket means, so that the adjustment can be performed only through rotation of the screw.

4. Window glass mounting means in accordance with claim 2 in which said hole in the body is located between the first and second portions.

5. Window glass mounting means in accordance with claim 2 in which said window glass support bracket means includes an upper and a lower flanges, said first portion of the guide follower being pivotably connected to the lower flange on the bracket means, said upper flange carrying further guide follower means for slidable engagement with the guide rail means.

6. Window glass mounting means in accordance with claim 3, in which said screw is provided with an annular flange whereby the guide follower means is axially restrained by said annular flange and a nut threadably engaged with the screw.

7. Window glass mounting means in accordance with claim 6 in which said hole in the body of the guide follower is large in diameter in relation to the guide rail means, said first portion of the guide follower having opposite surfaces which are adapted respectively to contact with said annular flange of the screw and the nut, each of said surfaces having largest axial height substantially at the center of the hole.

8. Window glass mounting means in accordance with claim 6 in which said panel means having weather seal strip means around the window opening, and said window glass being swung laterally about the seal strip means at lower edge of the window opening.

* * * * *